United States Patent [19]

Rossebo

[11] 4,137,846

[45] Feb. 6, 1979

[54] PRICE-MARKING STAMP DEVICE

[76] Inventor: Conrad Rossebo, 25211 Stockport, Laguna Hills, Calif. 92653

[21] Appl. No.: 821,466

[22] Filed: Aug. 3, 1977

[51] Int. Cl.[2] ..... B41J 1/58; B41J 1/08

[52] U.S. Cl. ..... 101/379; 101/406; 40/16.4

[58] Field of Search ..... 101/368, 379, 380, 405, 101/408; 40/16.2, 16.4, 16.6

[56] References Cited

U.S. PATENT DOCUMENTS

| | | | |
|---|---|---|---|
| 639,959 | 12/1899 | Becker | 101/379 |
| 791,868 | 6/1905 | Blythe | 101/368 |
| 1,420,376 | 6/1922 | Hellesoe | 101/368 |
| 2,900,902 | 8/1959 | Becker | 101/368 |
| 3,008,254 | 11/1961 | Smith | 40/16.6 |
| 3,266,417 | 8/1966 | Evers | 101/368 |
| 3,468,252 | 9/1969 | Lemelson | 101/379 |

FOREIGN PATENT DOCUMENTS

| | | | |
|---|---|---|---|
| 671807 | 5/1952 | United Kingdom | 101/368 |

*Primary Examiner*—William Pieprz
*Attorney, Agent, or Firm*—Francis X. Lo Jacono

[57] ABSTRACT

A price-marking stamp device adapted to be mounted to the molding positioned along the edge of a shelf having items stored thereon, whereby the consumer can individually mark the price of a selected item therefrom. The device comprises a main support body having a locking member to retain the device within the channel of the molding, and a movable ink-pad holder interconnected to the main support body by a ball-joint member, the ink-pad holder being arranged to removably receive various price-indicating ink pads, and the pad holder and ink pad being covered by a slidable housing which is spring-biased to normally receive and cover the ink pad, the ink pad having numerical indicator members disposed on the face thereof so as to be pressed against the selected item to be price-tagged, at which time the slidable housing is forceably retracted to expose the ink pad.

3 Claims, 6 Drawing Figures

FIG. 1
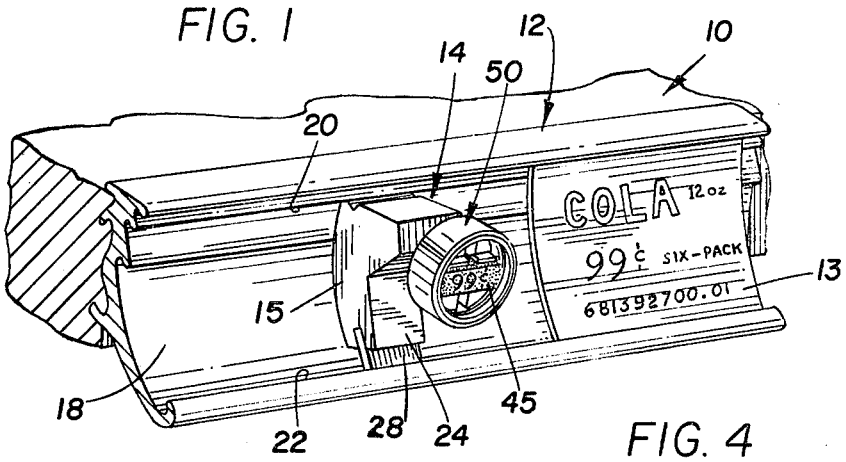
FIG. 4
FIG. 5
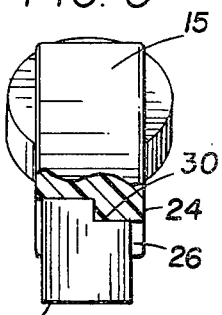
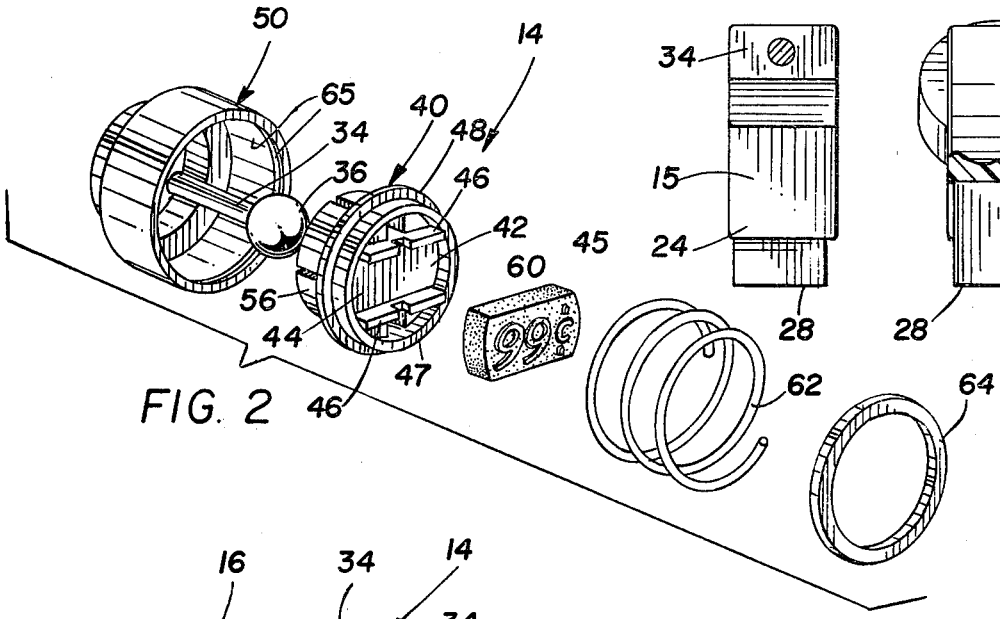
FIG. 2
FIG. 6
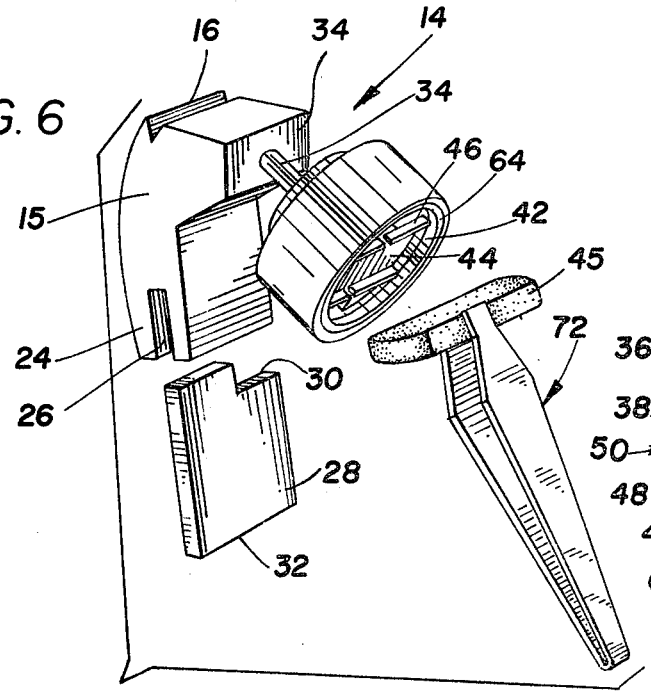
FIG. 3
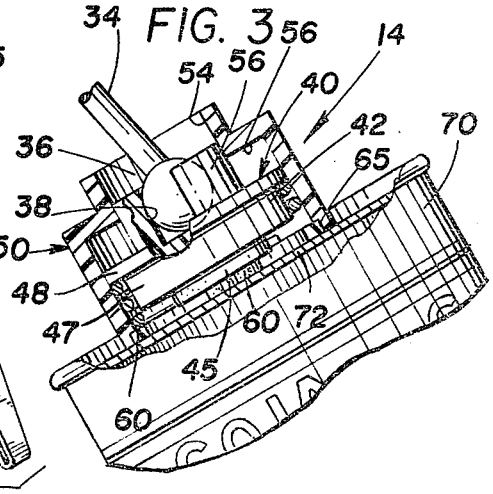

PRICE-MARKING STAMP DEVICE

BACKGROUND OF THE INVENTION

1. Field of the Invention

This invention relates generally to an ink-pad marking device and, more particularly, to an ink-pad marking device to be associated with marking products stored on grocery shelves and the like, wherein the device is directly mounted to the shelves, whereby the consumer can individually mark the selected item.

2. Description of the Prior Art

With the recent advent of the Universal Product Code System (UPC), which comprises the use of a combination of dark vertical lines and numbers that are printed on all items and packages — facilitating and hastening the work of checkers at the checkstands — there has been created a less beneficial effect for the consumer.

This new system, which also includes sophisticated computers (not clerks) to tabulate the shopper's bill, will help supermarkets reduce costs — and presumably increase profits. But its use will also result in consumers being denied essential price information, because the industry is planning to eliminate prices on individual items. In other words, computer-readable labels will replace legible price markings on stocked items.

There is a positive benefit when prices are clearly displayed on individual items. For example, a consumer may want to compare the prices of canned, frozen and fresh corn, or the price of an end-of-the-aisle special, with the standard shelf item. It is especially helpful for persons on limited and fixed incomes to be able to tabulate their total expenditures prior to check-out time.

Also, at the check-out counter, a shopper may want to compare the price stamped on an individual item against the price shown on both the checker's viewer and the print-out, to make certain he is not being overcharged.

In this time of soaring food costs, consumers must retain the practical tools to stretch their food dollars. Individual pricing is one such tool.

Thus, there is a need to provide a means by which consumers can readily mark each item with its current price value — and this can be accomplished with the present-disclosed invention.

SUMMARY OF THE INVENTION

The present invention provides a price-marking device that is adapted to be mounted to the channelled molding generally found positioned along the outer edges of shelves in supermarkets and other stores. These moldings have always been used to locate shelf labels and prices of items stored thereon.

Accordingly, the present invention comprises a main support body which is arranged to be removably affixed within the channel of the shelf molding, said support body having a locking bar to retain the device in place adjacent to its related product to be marked therewith.

A marking or ink-pad holder is movably attached to the support-body member by a ball-joint member whereby the holder can be readily adjusted to any angle, so as to bring its associated ink pad directly into engagement with the product to be marked. That is, the ink pad is removably mounted to the ink-pad holder; and the pad is provided with projecting numerical indicia which is transferred to the item to be marked therewith.

In order to protect the marking ink pad, there is included a slidable cover which is spring-biased outwardly to establish an annular protective wall when the marker is not in use. However, when an item is forced against the cover, it will retract — allowing the numerical indicia to engage the item and leave the selected price marked thereon.

The material of the ink pads is of the well-known type that has marking ink impregnated therein; and, when a price change is required, one simply removes the old price-marked pad with a pad having an updated figure.

OBJECTS AND ADVANTAGES OF THE INVENTION

The present invention has for an important object a provision whereby containers or packages of all types found in supermarkets and like places can be readily price-marked by the consumers when the items are removed from the shelves.

It is another object of the present invention to provide a price-marking device that is readily adaptable to be mounted to most moldings used to hold price labels.

It is still another object of the invention to provide a price-marking device for shelf items that will include a simple means for interchanging the numbered ink pads.

It is a further object of the invention to provide a marking device of this type that is easy to service and maintain.

Still another object of the invention is to provide a device of this character that is relatively inexpensive to manufacture.

It is still another object of the invention to provide an ink-marking device of this character that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

Referring more particularly to the accompanying drawings, which are for illustrative purposes only:

FIG. 1 is a pictorial view of the ink-pad-marking device mounted to the molding of a shelf;

FIG. 2 is an exploded view of the present invention, showing the printing-pad assembly;

FIG. 3 is a cross-sectional view of the printing-pad assembly pressed against an item to be price-marked;

FIG. 4 is a front-elevational view of the support body with a portion thereof shown in section;

FIG. 5 is a rear elevational view of support body with a portion thereof shown in section; and FIG. 6 is a pictorial view of the present invention, showing the ink pad to be removed by a special tool, and the locking member separated from the support body.

DESCRIPTION OF THE PREFERRED EMBODIMENT

Referring more particularly to FIG. 1, there is shown a fragment of a well-known shelf, generally indicated at 10, having a label-mounting mold, designated at 12, which is affixed along the longitudinal edge of said shelf 10 in a well-known manner.

As is well understood in the art, molding 12 has been typically employed to hold cards, labels or like price-indicating articles 13, whereby the consumer may see the price of the particular product.

As previously mentioned, as the Universal Product Code System becomes establishes, the price-marking of individual items will no longer be provided. Hence, there is a need for the presently disclosed price-marking device, generally indicated at 14. Said price-marking device 14 comprises a main support body 15 having an upper lip member 16 formed adjacent the rear upper edge of said body 14 so as to be received in a restraining mode within the channel area 18 of molding 12.

Channel area 18 is defined by a pair of oppositely disposed upper and lower grooves 20 and 22, respectively. Thus, lip 16 is arranged to be hooked within upper groove 20. Body 15 further includes a lower portion 24 having formed therein a recess 26 wherein a locking bar 28 is removably received therein, so as to define a locking means to restrain the price-marking device in a proper relationship with respect to the associated product to be marked thereby. The locking bar 28 is provided with a keyed end 30 to interconnect to the corresponding recess 26, as seen in FIG. 5.

Accordingly, locking bar 28 is positioned within recess 26 after main body 15 is located in channel 18, and lip 16 is received in groove 20. Thus, locking bar 28 interconnects the device to molding 12 when it is in place, the lower end 32 being positioned in lower groove 22, as seen in FIG. 1.

Body 15 is also provided with an outwardly projecting head member 34 in which is fixedly secured a ball-joint means having a stem 34 secured in head 34 and provided at its free end with a ball member 36. The stem and ball project outwardly from head member 24, wherein the ball member 36 is arranged to be received in a ball socket 38 which is formed in the rear portion of ink-pad-holder means indicated generally at 40.

Ink-pad-holder means 40 comprises an annular piston member 42 having at one end thereof ball socket 38, and at the opposite end thereof a cavity 44 in which ink pad 45 is received and held in place between two parallel rib members 46. Located around the outer peripheral wall 47 of member 42 is an annular flange 48.

There is also provided a slidable cover member, indicated at 50, having an enlarged bore 52, in which pad holder 40 is slidably received, and a reduced-diameter bore 54, in which socket wall 56 of pad holder 40 is disposed. Hence, flange 48 has a diameter substantially the same as enlarged bore 52; and socket wall 56 has substantially the same diameter as the reduced bore 54 — thus allowing pad-holder means 40 to slide with the respective bores 52 and 54.

To provide a normal retracted mode or position for pad holder 40, cover member 50 is spring-biased outwardly to protect ink pad 45 which includes indicia means such as numerical members 60, as seen in FIGS. 1 and 2. The spring biasing means is provided by a coil spring 62 disposed within recess 56, and positioned between flange 48 and restraining ring 64, which is arranged to be affixed in annular groove 65 of cover 50.

Thus, as can be seen in FIG. 3, when an item such as 70 is to be marked, the consumer removes it from shelf 10 and forces top 72 of item 70 against slidable cover 50, whereby cover 50 retracts and allows numerals 60 of ink pad 45 to engage top 72, thereby printing thereon the price of the desired item.

It is further contemplated that ink pads will be of the well-known permanent-ink type, and will be readily interchanged by a tweezer device such as indicated at 72 in FIG. 6. The store clerk merely has to remove or replace selected numerical ink pads with the tweezers, when required.

The invention and its attendant advantages will be understood from the foregoing description, and it will be apparent that various changes may be made in the form, construction and arrangement of the parts of the invention without departing from the spirit and scope thereof, or sacrificing its material advantages, the arrangement hereinbefore described being merely by way of example; and I do not wish to be restricted to the specific form shown or uses mentioned, except as defined in the accompanying claims.

I claim:

1. A price-marking device for use in conjunction with molding affixed to storage shelves, wherein the device comprises:

a main body-support member to be removably mounted to said molding;

mounting means formed on said main body to engage said molding in a locked position;

ink-pad-holder movably attached to said body-support member;

ball-joint member connected between said body-support member and said ink-pad-holder means;

an ink pad removably mounted in said ink-pad-holder means, said ink pad having indicia means formed thereon for engagement with items to be price-marked, wherein said ink-pad-holder means comprises:

an annular piston member having a cavity disposed therein to removably receive said ink pad therein, a cover housing slidably mounted over said piston member, and biasing means disposed between said piston member and said cover housing, whereby said ink pad is protected in a non-use mode; and wherein said molding includes a channel having an upper and a lower longitudinal groove, and wherein said mounting means comprises:

a lip member formed on the upper portion of said body-support member to be received in the upper groove of said channel, and a locking bar positioned between said body-support member and said lower groove of said channel.

2. A price-marking device as recited in claim 1, wherein said ball-joint means comprises:

a stem member fixedly secured to said body-support member;

a ball member formed on one end of said stem member;

a ball joint formed in said annular piston to receive said ball therein, and to allow movement of said ink-pad-holder means.

3. A price-marking device as recited in claim 1, including means inserting and removing said ink pad from said cavity of said piston member.

* * * * *